United States Patent [19]

Brown et al.

[11] 4,384,415

[45] May 24, 1983

[54] TRENCHING PLOW

[75] Inventors: Robert J. Brown; Andrew C. Palmer, both of The Hague, Netherlands

[73] Assignee: R. J. Brown & Associates AG, Zug, Switzerland

[21] Appl. No.: 815,002

[22] Filed: Jul. 12, 1977

[51] Int. Cl.[3] ..... E02F 5/02; F16L 1/02

[52] U.S. Cl. ..... 37/98; 37/54; 405/159; 405/174

[58] Field of Search ..... 61/72.4, 72.6, 105, 61/107; 37/98

[56] References Cited

U.S. PATENT DOCUMENTS

| | | | |
|---|---|---|---|
| 43,060 | 6/1864 | Wiggin | 37/98 |
| 51,859 | 1/1866 | Perkins | 37/98 |
| 62,215 | 2/1867 | Miller | 37/98 |
| 79,851 | 7/1868 | O'Connor et al. | 37/98 |
| 86,947 | 2/1869 | Sheets | 37/98 |
| 90,495 | 5/1869 | Burtless | 37/98 |
| 152,436 | 6/1874 | Tichenor | 37/98 |
| 289,839 | 12/1883 | House | 37/98 |
| 716,992 | 12/1902 | Dooling | 37/98 |
| 2,144,063 | 1/1939 | Irvin | 61/72.4 |
| 2,195,631 | 4/1940 | Post et al. | 37/98 X |
| 2,715,286 | 8/1965 | Savenson . | |
| 3,641,780 | 2/1972 | Ede | 61/72.4 |

FOREIGN PATENT DOCUMENTS

| | | | |
|---|---|---|---|
| 5369 | 12/1931 | Australia | 37/98 |
| 653531 | 3/1929 | France . | |
| 714173 | 11/1931 | France . | |
| 1017586 | 12/1952 | France | 37/98 |
| 255931 | 7/1926 | United Kingdom . | |
| 536741 | 5/1941 | United Kingdom | 37/98 |
| 1161565 | 8/1969 | United Kingdom . | |
| 1349515 | 4/1974 | United Kingdom . | |
| 1477815 | 6/1977 | United Kingdom | 37/98 |

*Primary Examiner*—Dennis L. Taylor

*Attorney, Agent, or Firm*—Cushman, Darby & Cushman

[57] ABSTRACT

A trenching plow and technique for its use, especially for forming a trench under water for receipt of pipe. The plow includes a frame with a tandem set of wheels at the front, and a share with mould boards mounted at the back of the frame. During trenching the frame always makes a positive angle with respect to the horizontal, and a soil furrow splitter is formed on the bottom of the frame. A pair of coulters are mounted to the frame in front of the share, each of the coulters raking forward at an angle of about 60°–70° to the horizontal, and the coulters being staggered along the length of the frame. The coulters also have a positive clearance angle with the trench side wall, and they extend to a depth about two-thirds the depth of the share. A trench having a depth of about 1.1 meters with side walls at an angle of about 60° to the horizontal may be formed at a towing speed of about two knots, the trench being formed having constant cross-section and constant depth.

9 Claims, 6 Drawing Figures

TRENCHING PLOW

BACKGROUND AND SUMMARY OF THE INVENTION

The invention relates to a trenching plow, especially one for the formation of a constant cross-section, constant depth trench under water for the receipt of a pipe therein, and a method for utilizing the plow for laying pipe.

Trenching plows, per se, have existed for quite some time, such as those shown in U.S. Pat. Nos. 152,436 and 1,436,614. Forestry drainage plows are commercially-available for cutting V-shaped trenches in the earth, such as a Finnish plow called "Lokomo," and a plow made by W. Clark Ltd. at Park Gate in the United Kingdom. While such plows are generally useful, they are not readily adaptable for the formation of constant depth, constant cross-section trenches under water for laying pipe, or for other particular uses requiring constant depth, constant cross-section furrows under a wide variety of operating conditions and in a wide variety of soils. The plow according to the present invention is capable of forming a trench with constant cross-section and constant depth for the receipt of pipe therein, especially underwater trenches (although the plow of the invention may be utilized for formation of surface trenches).

The plow according to the invention includes a frame member with a tandem set of wheels mounted to a forward portion of the frame member. A share is mounted to the frame member posterior of the set of wheels, and mould boards are mounted with the share. A pair of coulters—knife, disc, or the like—are mounted to the frame interior of the share, one of the coulters being located on either side of a vertical plane generally containing the share. The coulters are mounted so that they cause soil failure inwards and decrease to minimum proportion the disturbance of the trench walls. Also, in underwater trenching, the coulters allow water into the sliding surface and thereby facilitate trenching. To ensure that the draft is not excessive, and to ensure that the coulters do not tend to lift the plow out of the ground, each of the coulters is arranged to rake forwardly at a positive angle $\beta$ to the horizontal, the angle $\beta$ being about 60°–70°. The blades are sharpened and set to give a clearance relative to the furrow wall, the coulters having a positive clearance angle $\epsilon$ of about 5° to the trench side walls. The coulters extend to a depth less than the depth to which the share extends during trenching, preferably about two-thirds the depth. If a trench with sloping side walls is to be formed, the coulters are arranged to make a positive angle $\Delta$ (corresponding to the angle that the side walls of the trench are to form) with respect to the horizontal, projections of the coulters forming a V.

According to another aspect of the present invention, a trenching plow is provided including a substantially linear frame member, a tandem set of wheels mounted anteriorly of, and to, said frame member, a share mounted to the posterior end of the frame member and mould boards mounted with the share, and the tandem set of wheels, share, and frame members arranged so that during trenching the frame member always makes a positive angle $\alpha$ with respect to the horizontal. (That is, the frame member is always inclined upwardly from the anterior to the posterior thereof.) The frame member includes a lower portion that is sharpened to a V which comprises means for splitting soil furrows formed by the share and mould boards during trenching. When knife coulters are provided in order to ensure that the furrow slicer is not squeezed, the coulters are staggered along the length of the frame member. The position of the wheels is adjustable, which adjustment assists in determining the depth of the trench to be formed, and means are provided for adjusting the shave angle of the share, said means including means for adjusting the position of the share with respect to the frame member including a shear pin operatively connecting the frame member to the share.

The trenching plow according to the invention is operable in any method of laying pipes substantially under water. The plow is towed at substantially constant speed, and a trench is formed having constant cross-section and constant depth, wherein natural particles transport of the spoils formed during cutting will re-heal the trench to some extent. The sides of the furrow in front of the plow are cut with coulters to allow water into the sliding surface, which water seepage facilitates the formation of the trench with the share, the penetration of the water reducing the drag forces on the plow. Pipe is then disposed in the constant cross-section, constant depth trench so formed. The plow may be pulled together with, as an integral part of, the pipe; or, the plow may be pulled separately before the pipe, or, the plow may be pulled ahead of the pipe in steps where the plow would be pulled over a given distance and then the pipe would be pulled over the same distance up to the plow, with the process being repeated over the entire length of the pipeline. The trench is preferably formed with side walls making an angle of about 60° with respect to the horizontal—this minimizes the depth of trench one must form to properly lay pipe. According to the invention, it is possible to form a trench of about 1.1 meters depth in strong clay soil while maintaining a pulling speed of about two knots. As the pulling speed is reduced, the force necessary to form the trench is also reduced, however, it is of course desirable to have as high a speed as possible in order to reduce the time for formation of the trench in laying pipe.

It is the primary object of the present invention to provide a plow for formation of a trench having constant cross-section and constant depth, particularly for the laying of pipe therein. This and other objects of the invention will become clear from an inspection of the detailed description of the invention, and from the appended claims.

DETAILED DESCRIPTION OF THE INVENTION

Figure 4:
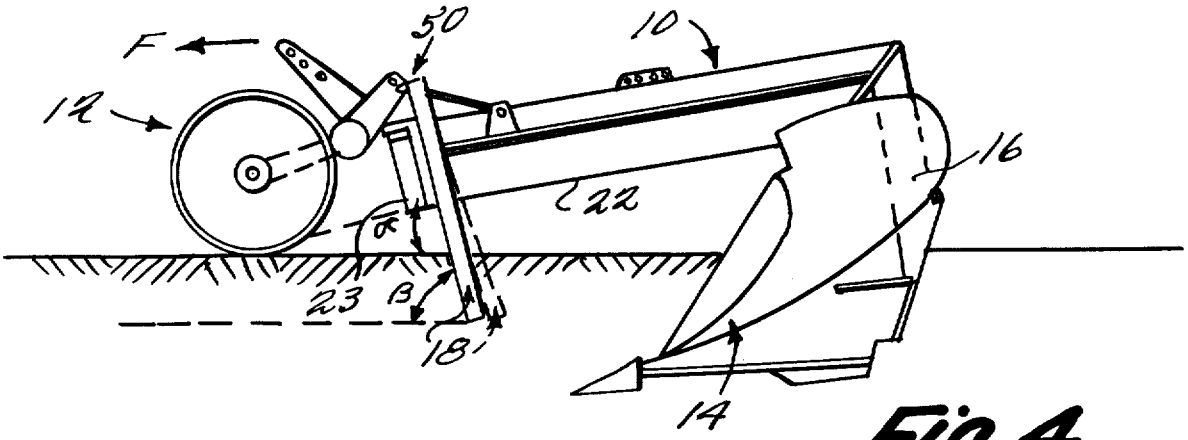
FIG. 4 is a schematic view showing the plow of FIG. 1 in operation.

The plow according to the invention includes a frame member 10 with a tandem set of wheels 12 mounted to a forward portion of the member 10, a share (cutting blade) 14 mounted to the member 10 posterior of the wheels 12, and mould boards 16 associated with the share 14. A pair of coulters 18 preferably are mounted to the frame 10 anterior of the share 14, one of the coulters 18 being located on either side of a vertical plane generally containing the share 14. The tandem set of wheels 12, share 14, and frame member 10 are arranged so that during trenching the frame member 10, which is substantially linear, always makes a positive angle $\alpha$ with respect to the horizontal (see FIG. 4). A towing force F (see FIG. 4) is applied to the plow to effect movement thereof, and trenching, the arrangement of the components effecting the formation of a trench of constant depth and cross-section as the plow is pulled by a towline.

Figure 3:
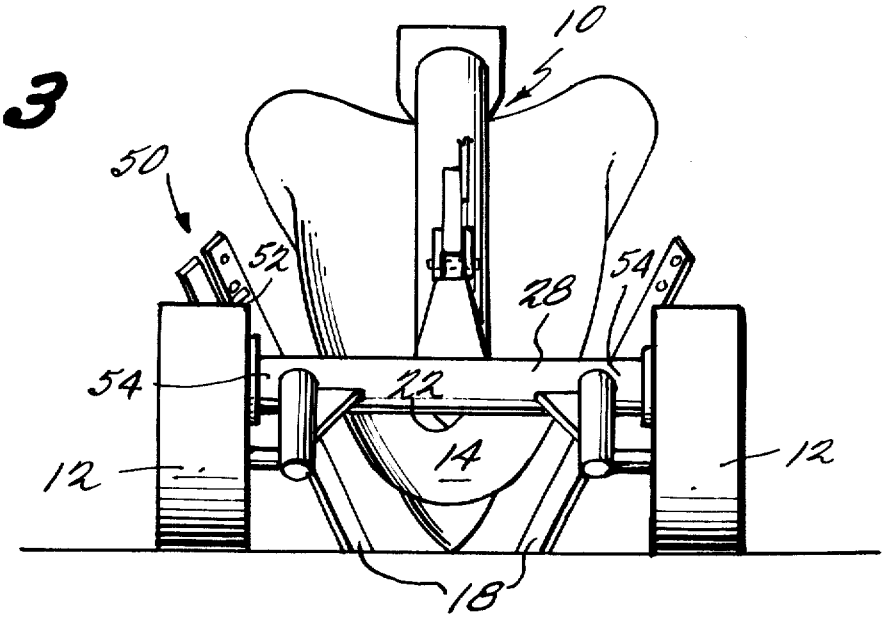
FIG. 3 is a front view of the plow of FIG. 1.

The frame member 10 is substantially linear and includes a top portion 20 which may be generally circular in configuration and a bottom portion 21. The bottom portion 21 reinforces the upper portion 20, and additionally is tapered—having a generally V-shaped cross-section (see FIG. 3) so that it has a blade 22 formed on the bottom thereof. The blade 22 functions as a means for splitting soil furrows formed by the share and mould boards during trenching, soil coming in contact with the blade 22 being guided to either side by the sloping walls of the portion 21. A bracket assembly 23 is mounted to the front of the member 10 for mounting the wheels 12, and a support member 24 is mounted at the posterior end of the frame 10, the member 24 extending at substantially a right angle with respect to the frame 10 and supporting the share 14 and mould boards 16 so that they are disposed at the posterior end of the frame 10.

The wheels 12 preferably are mounted so that they are adjustable, means 26 being provided for mounting the wheels 12 for adjustment thereof with respect to the frame 10. The adjustment means 26 includes a bushing arrangement 27 operatively mounted by a cylinder 28 or the like to the wheels 12, and mounted to a shaft 29 received by outwardly extending portions 30 of the bracket assembly 23. An arm 32 extends outwardly from cylinder 28 and is attached to an axle 33 of a hub 34 of an associated wheel 12. A pair of gusset plates 35 are also rigidly attached to the cylinder 28 for movement therewith, the gusset plates 35 having at least one opening 36 formed therein for attachment of a lever arm 37 to the plates 35. The lever arm 37 is adjustable in length, and is pivotally mounted to plates 35 at apertures 36, and is further pivotally mounted to a bracket 38 mounted to the frame upper portion 20. The cylinder 28 is rotated about shaft 29 until the proper vertical position of the axles 33 with respect to the frame member 10 is obtained, and then the lever arm 37 of proper adjusted length is disposed in connection with the bracket 38 and plates 35 to hold the axles 33 in the position to which they have been adjusted. Other means could also be provided for effecting adjustment, or where the plow was to be used solely to form trenches of one size, the adjustment means could be eliminated entirely.

Figure 2:
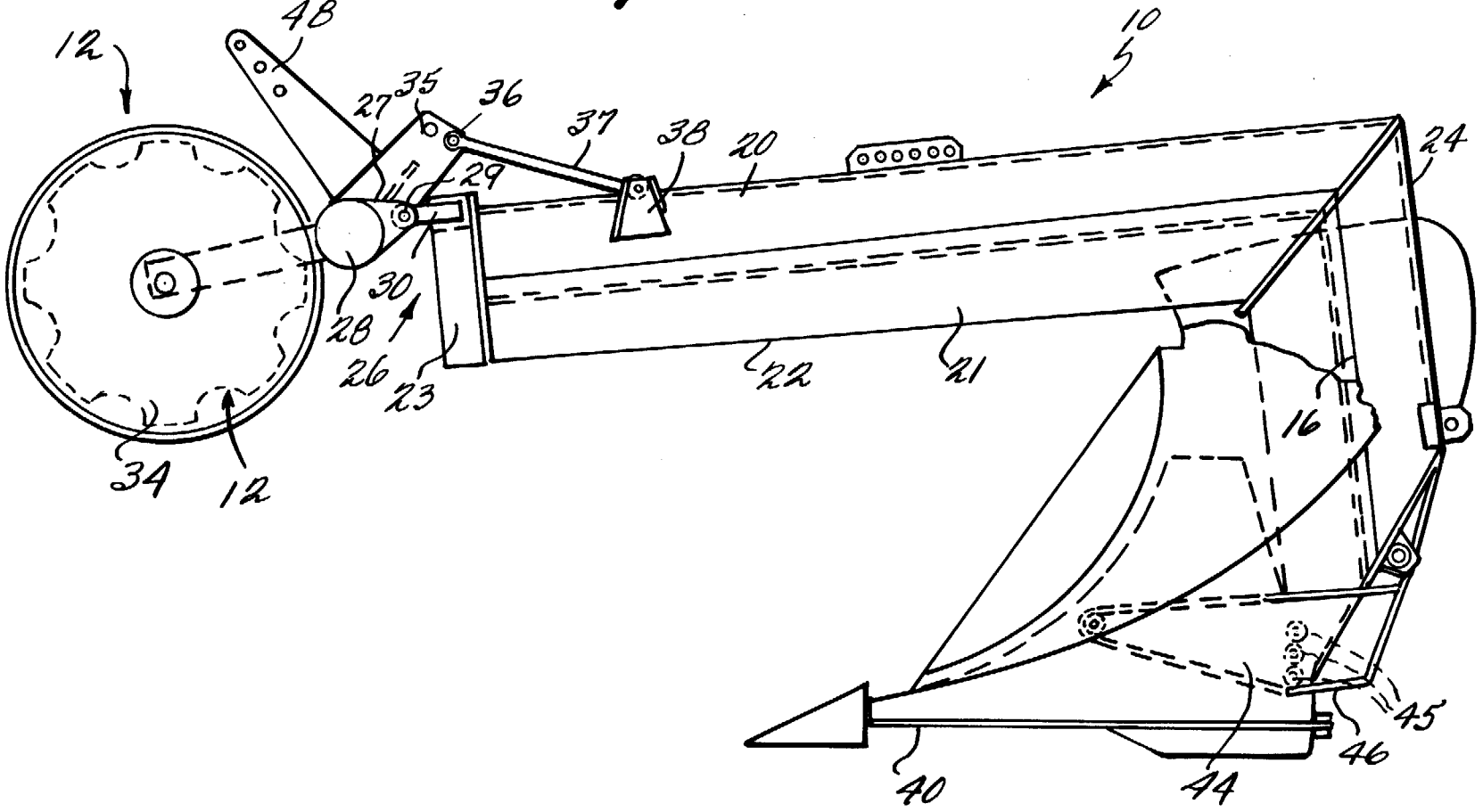
FIG. 2 is a side view of the plow of FIG. 1 with the near side wheel and the coulters removed for clarity.

The share 14 and mould boards 16 of the plow according to the invention may be obtained commercially. For instance, a forestry plow made by W. Clark Ltd. at Park Gate, United Kingdom, is suitable for use in the invention, and other commercially-available structures also may be suitable. The share 14, as shown in detail in FIG. 2, includes a sole 40, the share and sole being adjustable by pivoting thereof about pivot point 42. A plate 44 (shown at dotted line in FIG. 2) may extend from the downwardly extending member 24, and a pivot pin may be connected thereto and to the share 14 at 42. At another location spaced from 42 a plurality of openings 45 may be provided in either the share or plate 44, and a cooperating opening formed in the other of the share and plate. A shear pin 46 will extend through the openings holding the share 14 in a specific position to which it is pivoted with respect to to the member 24. The shear pin 46 may be designed to fail before damage results to structural components of the share and mould boards, i.e., to fail at 10 tons.

A towline for towing the plow may be attached at any convenient point of the plow. One suitable location is to bracket 48 extending outwardly from the cylinder 28, the bracket 48 having a number of openings formed therein for receipt of means associated with a towline. The towline can be connected to any conventional power source, such as a winch located on land or a ship (when underwater trenching is to be effected), or the like.

Figure 1:
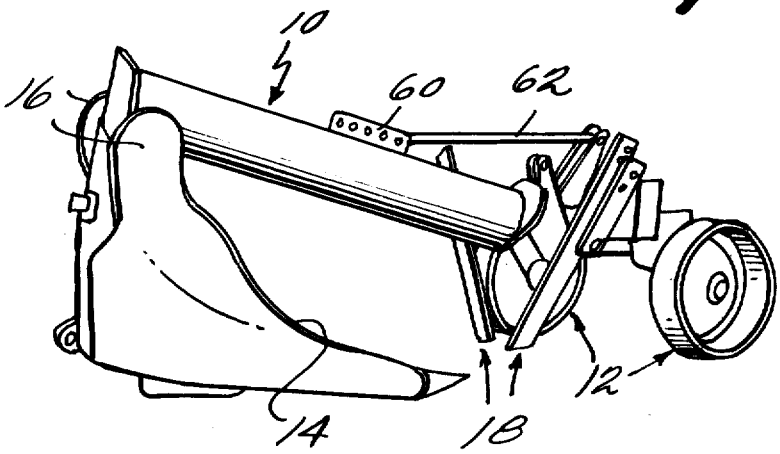
FIG. 1 is a perspective of an exemplary plow according to the invention.

The coulters 18 according to the present invention are illustrated as knife coulters in the drawings, however, it is to be understood that they can be in the form of discs, or may have a wide variety of other shapes as long as they perform their desired function. The coulters 18 are mounted to a portion of the frame 10 anterior of the share 14. While a wide variety of mounting means can be employed, an exemplary mounting means 50 for the coulters 18 includes a plate 52 for each coulter mounted to extensions 54 of cylinder 28 (see FIGS. 1 and 3 in particular). The plates 52 are disposed at the desired angles with respect to the horizontal and vertical for effective cutting by the coulters, and a plurality of such plates may be provided on each side of a vertical plane passing through the share and the frame in order to provide some adjustability for the distance between the coulters (and thus width of the trench). The coulters may be attached to the plates 52 by bolts, or by other suitable fastening means.

Figure 5:
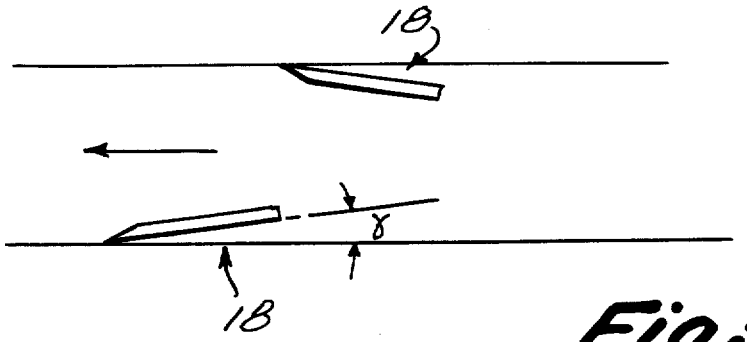
FIG. 5 is a top schematic showing the arrangement of knife coulters for the FIG. 4 plow.

The coulters 18 can serve a variety of purposes. First of all, they reduce dilation of the trench walls, give stability by sloping the trench walls (when disposed at an angle with respect to the vertical), and when cutting underwater allow the water into the sliding surface to facilitate subsequent trenching by the share 14 and mould boards 16. The coulters normally result in a reduction of the draft as compared to a plow without coulters. Unless the coulters are properly positioned, however, they can increase the draft and can tend to lift the plow out of the ground. By positioning each of the coulters to rake forwardly at a positive angle $\beta$ with the respect to the horizontal (see FIG. 4) any tendency to increase the draft or to lift the plow can be avoided. The coulters are most effective in this regard where $\beta$ is equal to about 60°-70°. The coulters are sharpened and set to give a clearance relative to the furrow wall. As illustrated in FIG. 5, a clearance angle $\epsilon$ is provided, wherein $\epsilon$ may be chosen to be about 5°. Mounted in such a way, the coulters only cause soil failure inwards and decrease to a minimum proportion the disturbance in the trench walls. Additionally, the coulters are staggered (again see FIG. 5) along the length of the frame 10, a leading cutting portion of one coulter being disposed anterior of a leading cutting portion of the other coulter. The plates 52 for mounting the coulters are disposed so that the staggered relationship is provided. By staggering the coulters along the length of the frame 10, squeezing of the furrow slicer 21, 22 is avoided. Desirably, the effective cutting depth of the coulters does not extend to the effective cutting depth of the share during trenching. For most effective trenching, with knife coulters, each coulter extends to about two-thirds the depth to which the share extends during trenching.

The plow can be constructed so that it will be able to drive past boulders or other objects that it encounters, or so that it is cammed out of the way by larger objects. For instance, an apertured bracket 60 may be provided about half way up the frame upper portion 20, and a force transmitting rod 62 (see FIG. 1 in particular) connected from the apertured bracket 60 to the bracket 48. When the share 14 encounters a particularly immovable underground object, it can be cammed upwardly—generally about the axis defined by shaft 29—the mechanical advantage provided by the connection from bracket 60 to bracket 48 by the rods 62 transmitting the camming force to the wheels 12, the wheels 12 tending to be forced into the soil being cut (especially underwater). A suitable spring loading also could be provided.

Figure 6:
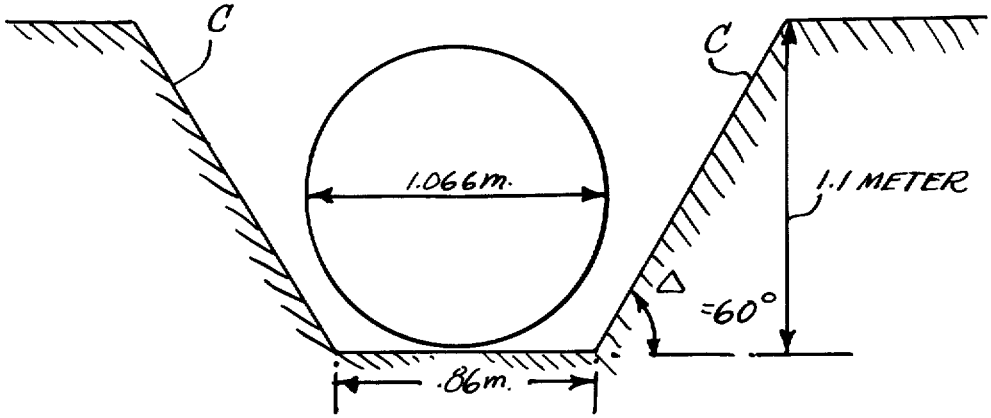
FIG. 6 is a schematic showing a trench as formed according to the present invention with pipe disposed therein.

The apparatus according to the present invention is especially useful for the formation of trenches for the laying of pipe. The trench formed according to the present invention has a constant cross-section and constant depth, and natural particles transport of the spoils formed during cutting will reheal the trench to some extent. The invention is particularly adapted for cutting trenches substantially under water. The plow is towed at a substantially constant speed, and the sides of the trench to be formed are cut by coulters 18 in front of the plow, the coulters allowing water into the sliding surface (this is common terminology in the art referring to a surface formed by the cut of the coulters, on which surface relative motion occurs.), which makes subsequent formation of the trench by the share easier. Preferably the trench side walls that are formed are sloped in order to give greater stability to the trench. This is most preferably facilitated by the provision of the knife coulters at an angle Δ with respect to the horizontal (see FIG. 6) of about 60°. The trench formed by the plow according to the invention with the coulters disposed at the angle Δ is illustrated schematically in FIG. 6, the trench having a substantially V-shaped cross-section with truncated bottom B and with the trench side walls C making the angle Δ of about 60° with respect to the horizontal. By forming a trench as illustrated in FIG. 6, it is possible to lay a pipe of a larger diameter than the width of the bottom B of the trench being formed, and thus a shallower trench can be formed for a given size pipe. The trench formed for the laying of pipe having a diameter of approximately 1.066 meters (a conventional size) is about 1.1 meters in depth, with the width of the bottom B approximately 0.86 meter. Using a plow according to the present invention, it is possible to form a trench as illustrated in FIG. 6 in strong clay while maintaining a pulling speed of about two knots. As the pulling speed is reduced, the amount of force necessary to form the trench is also reduced, however, then it obviously takes longer to form the trench. A speed of about two knots is desirable for trench formation.

The plow may be pulled from a surface vessel (tug, barge or the like), or from a land base site with a winch, tractor, or the like. The plow may be pulled together with, as an integral part of, the pipe, or it can pulled separately from the pipe. It may be pulled ahead of the pipe in steps where, for example, the plow would be pulled over a given distance (i.e., 100 yards) and then the pipe would be pulled over the same distance up to the plow, with the process being repeated over the entire length of the pipeline. The pipe may be pulled behind the plow into the trench at substantially the same speed as that at which the plow was pulled.

In utilizing the plow according to the present invention in a conventional operation thereof, the wheels 12 are adjusted by pivoting them about the shaft 29 and maintaining them in the position to which they have been adjusted by fastening the lever arm 37 in one of the openings 36 in gusset plates 35, the adjustment of the wheels adjusting the depth of the trench to be formed. The trench depth may also be adjusted by adjusting the shave angle of the share by removing pin 46 and pivoting the share with respect to the frame portion 24 about the shaft 42, and then reinserting the pin through a proper opening 45.

After adjustment has been made for the proper trench depth (i.e., 1.1 meters), the coulters 18 are mounted by mounting means 50, the coulters forming an angle Δ with respect to the horizontal, and raking forward at an angle $\beta$ to the horizontal and having a positive clearance angle $\gamma$ with the trench side walls C being cut thereby. The coulters extend to about two-thirds the depth of the share during trenching.

A towline is connected up to bracket 48, and towing force is applied to the plow, the coulters 18 cutting the side walls C of the trench and allowing seepage of water into the sliding surface. The share 14 then displaces the soil, forcing it upwardly, and the frame portions 21, 22 split the soil furrows formed during trenching. The frame member 10 makes a positive angle $\alpha$ with respect to the horizontal during trenching; the trench formed by the plow is illustrated in FIG. 6. The trench formed has a constant cross-section and constant depth, and natural particles transport of the spoils formed during cutting will reheal the trench to some extent. Preferably the trench has a substantially V-shaped cross-section with truncated bottom B and the trench side walls making an angle Δ of about 60° with respect to the horizontal.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A trenching plow comprising (a) a frame member including a furrow splitter having a lower V-shaped portion, (b) a set of wheels mounted to a forward portion of said frame member, and comprising the only wheels associated with the plow, (c) a share mounted to said frame member posterior of said set of wheels, (d) mould boards mounted with said share, (e) a pair of coulters, and (f) means for mounting said coulters to said frame anterior of said share: so that one of said coulters is located on either side of a vertical plane generally containing said share; and so that each of said coulters rakes forwardly at a positive angle $\beta$ to the horizontal; and so that one of said coulters has a leading cutting portion thereof disposed anterior of a leading cutting portion of the other coulter and said coulters are staggered along the length of said frame.

2. A trenching plow comprising a substantially linear frame member, a set of wheels anteriorly of, and to, said frame member, a share mounted to the posterior end of said frame member, mould boards mounted with said share, said set of wheels, share, and frame member arranged so that during trenching said frame member is always inclined upwardly from the anterior to the posterior thereof; and means for splitting soil furrows formed by said share and mould boards during trenching, said means comprising a lower V-shaped portion of said frame member.

3. A plow as recited in claim 2 wherein said tandem wheels are spaced equidistant from a vertical plane containing said share, and wherein said tandem wheels are spaced a distance greater than or equal to the greatest width of said mould boards.

4. A plow as recited in claim 2 further comprising means for mounting said tandem set of wheels to said frame member for adjusting the vertical position of the centers of said wheels with respect to said frame member.

5. A plow as recited in claim 4 wherein said adjustment mounting means includes a shaft having a horizontal axis, and mounted to said frame member, and means for mounting said tandem set of wheels to said shaft for pivotal movement of said wheels about said horizontal axis to thereby adjust the vertical position of said wheels with respect to said frame.

6. A plow as recited in claim 5 further comprising means for holding said tandem wheels in the position to which they have been pivoted about said horizontal axis, said means comprising an apertured plate connected to said shaft for rotation therewith, an adjustable length lever arm, and means for attaching said lever arm to said frame member.

7. A plow as recited in claim 2 further comprising means for adjusting the shave angle of said share, said means comprises means for adjusting the position of the share with respect to the frame member, said means including a shear pin operatively connecting said frame member to said share.

8. A plow as recited in claim 2 further comprising a pair of coulters mounted to said frame anterior of said share and posterior of said tandem set of wheels, one of said coulters being located on either side of a vertical plane generally containing said share, and one of said coulters having a leading cutting portion thereof disposed anterior of a leading cutting portion of the other coulter so that said coulters are staggered along the length of said frame.

9. A plow as recited in claim 8 wherein said coulters are disposed so that they have a positive clearance angle with trench sidewalls being cut thereby, and extend to a depth less than the depth to which the share extends, and rake forwardly at an angle of about 60°–70° to the horizontal.

* * * * *